US006663515B1

(12) United States Patent
Pai

(10) Patent No.: US 6,663,515 B1
(45) Date of Patent: Dec. 16, 2003

(54) RACKET WITH A HEAD AND A HANDLE BOTH MADE OF DIFFERENT MATERIALS

(76) Inventor: Chin-Dong Pai, 20-3 Fl., No. 123, Sec. 3, Jonggang Rd., Taichung (TW)

( * ) Notice: Subject to any disclaimer, the term of this patent is extended or adjusted under 35 U.S.C. 154(b) by 0 days.

(21) Appl. No.: 10/219,156

(22) Filed: Aug. 15, 2002

(51) Int. Cl.[7] ..... A63B 49/02

(52) U.S. Cl. ..... 473/521; 473/535; 473/536; 473/546

(58) Field of Search ..... 473/520, 521, 473/524, 535, 536, 546, 547, 549

(56) References Cited

U.S. PATENT DOCUMENTS

| | | | | | |
|---|---|---|---|---|---|
| 4,725,059 | A | * | 2/1988 | Du Gardin et al. | 473/536 |
| 4,983,242 | A | * | 1/1991 | Reed | 156/172 |
| 5,175,919 | A | * | 1/1993 | Lo | 29/460 |
| 5,238,247 | A | * | 8/1993 | Davis | 473/537 |
| 5,314,180 | A | * | 5/1994 | Yamagishi et al. | 473/521 |
| 5,421,574 | A | * | 6/1995 | Yamagishi et al. | 473/282 |
| 5,860,878 | A | * | 1/1999 | You | 473/549 |
| 6,071,203 | A | * | 6/2000 | Janes et al. | 473/535 |
| 6,500,080 | B2 | * | 12/2002 | Severa et al. | 473/521 |
| 2002/0165050 | A1 | * | 11/2002 | Severa et al. | 473/524 |
| 2003/0036447 | A1 | * | 2/2003 | Niwa et al. | 473/520 |
| 2003/0036448 | A1 | * | 2/2003 | Severa et al. | 473/521 |

FOREIGN PATENT DOCUMENTS

| | | | | |
|---|---|---|---|---|
| JP | 6-63183 | * | 3/1994 | A63B/49/10 |

* cited by examiner

*Primary Examiner*—Raleigh W. Chiu
(74) *Attorney, Agent, or Firm*—Alan D. Kamrath; Rider Bennett, LLP

(57) ABSTRACT

A racket is composed of multiple sections of tubes made of different material with resilient material bonded between the tubes at the joints to attenuate vibration and shock and thus make striking a ball more comfortable for a player.

6 Claims, 4 Drawing Sheets

RACKET WITH A HEAD AND A HANDLE BOTH MADE OF DIFFERENT MATERIALS

BACKGROUND OF THE INVENTION

1. Field of the Invention

The present invention relates to a racket that is composed of a head and handle both made in different materials to make the racket have an excellent anti-shock feature to prevent a player from sustaining a sport's injury due to vibration caused by striking an object.

2. Description of Related Art

"Tennis elbow" is a sport's injury common to players of tennis or other similar sports that use a racket and is caused from shock and vibration when a player strikes a ball with the racket. Therefore, racket manufacturers constantly try to produce rackets with better anti-shock features.

With reference to FIGS. 6 and 7, a conventional racket (50) is a one-piece racket and is composed of a frame (51), a Y-shaped neck (52) and a handle (53). The frame (51) made of a hollow tube forms an open oval face (54) with two ends so strings can be strung inside the oval face (54). With reference to FIG. 5, the hollow tube that forms the frame (51) further has a curved inner and outer edge so the frame (51) will resist deformation. The Y-shaped neck (52) has a forked end (not numbered) and a proximal end (not numbered). The forked end is attached to the frame (51) so the neck (52) extends out from one end of the frame (51). The handle (53) is formed at the proximal end of the Y-shaped neck (52).

The conventional racket (50) is one piece so shock and vibration generated when striking a ball is transmitted directly to the handle (53). Therefore, when players hold the conventional racket (50) at the handle (53) during play, they easily sustain sport's injuries such as tennis elbow caused by the vibration and shock.

To overcome the shortcomings, the present invention tends to provide an anti-shock racket to mitigate and obviate the aforementioned problems.

SUMMARY OF THE INVENTION

The main objective of the invention is to provide a racket with a head and a handle made of different materials that attenuates and damps vibration and shock efficiently.

Objectives, advantages and novel features of the invention will become more apparent from the following detailed description when taken in conjunction with the accompanying drawings.

DETAILED DESCRIPTION OF PREFERRED EMBODIMENT

Figure 1:
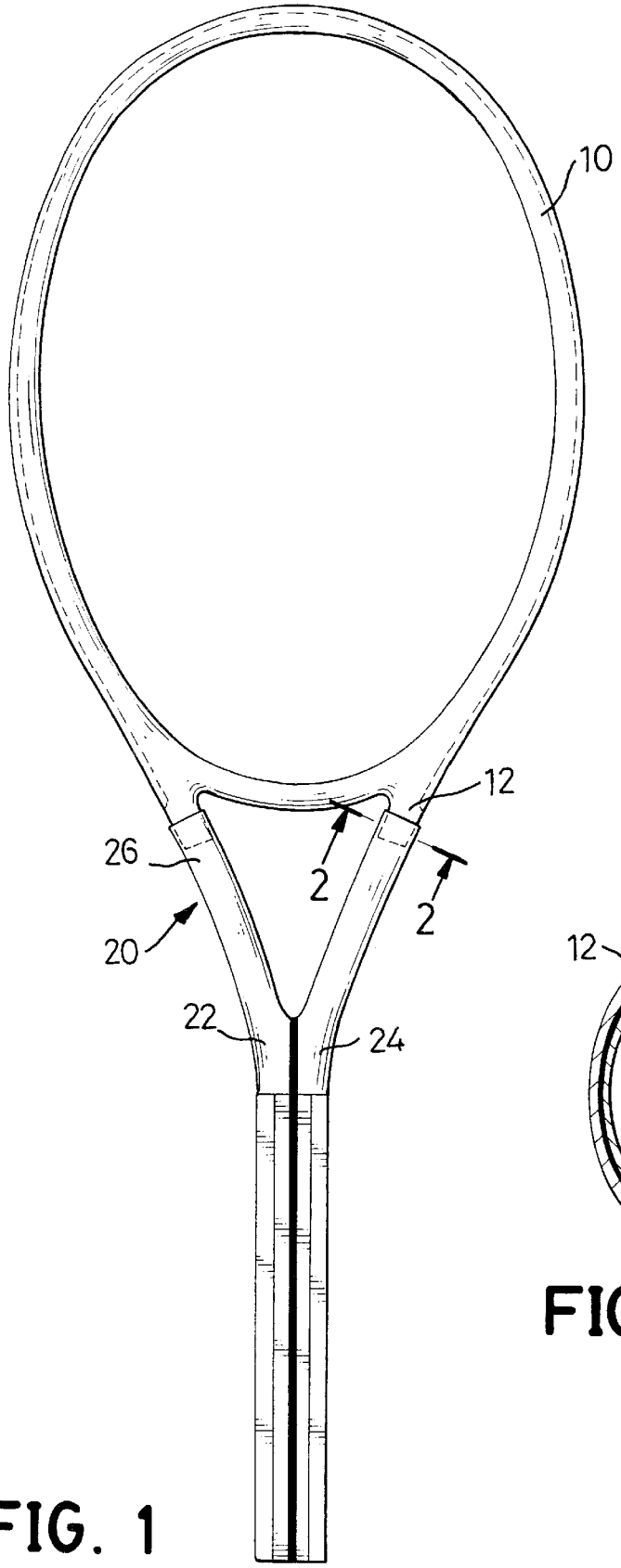
FIG. 1 is a front plan view of a racket in accordance with the present invention.
Figure 2:
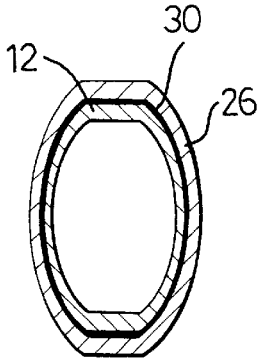
FIG. 2 is an enlarged cross-sectional view of the racket along line 2—2 in FIG. 1.

With reference to FIGS. 1 and 2, a racket is formed in sections and comprises a head (10) and a handle (20).

The head (10) is an open oval frame made of thermosetting resin mixed with carbon fiber and has a bottom end. Two connecting stubs (12) are formed tangentially near the bottom end of the head (10). The thermosetting material makes the head (10) rigid so the racket strings can be strung inside the open oval frame.

The handle (20) is Y-shaped and composed of two symmetrical tubes (22, 24) joined over a part of their length to form a forked end having two distal ends (26) and a proximal end (not numbered). A grip is formed at the proximal end of the handle (20). The forked end of the handle (20) sleeves on the connecting stubs (12) of the head (10) by bonding a resilient material (30) at joints between the forked end and the head (10). The resilient material (30) is a high performance adhesive that provides a strong bond and has an elastic property after drying and a high damping coefficient to absorb any vibration and shock. Additionally, the two symmetrical tubes (22, 24) are joined longitudinally in the same manner that the handle (20) connects to the head (10) to form the grip. Therefore, resilient material (30) between the symmetrical tubes (22, 24) forming the grip provides additional shock attenuation and damping by absorbing additional vibration and shock that may be transmitted to the handle (20).

In other aspects, the handle (20) is made of thermoplastic resin mixed with carbon fiber to make the handle (20) have excellent resilience and anti-shock efficiency.

Figure 3:
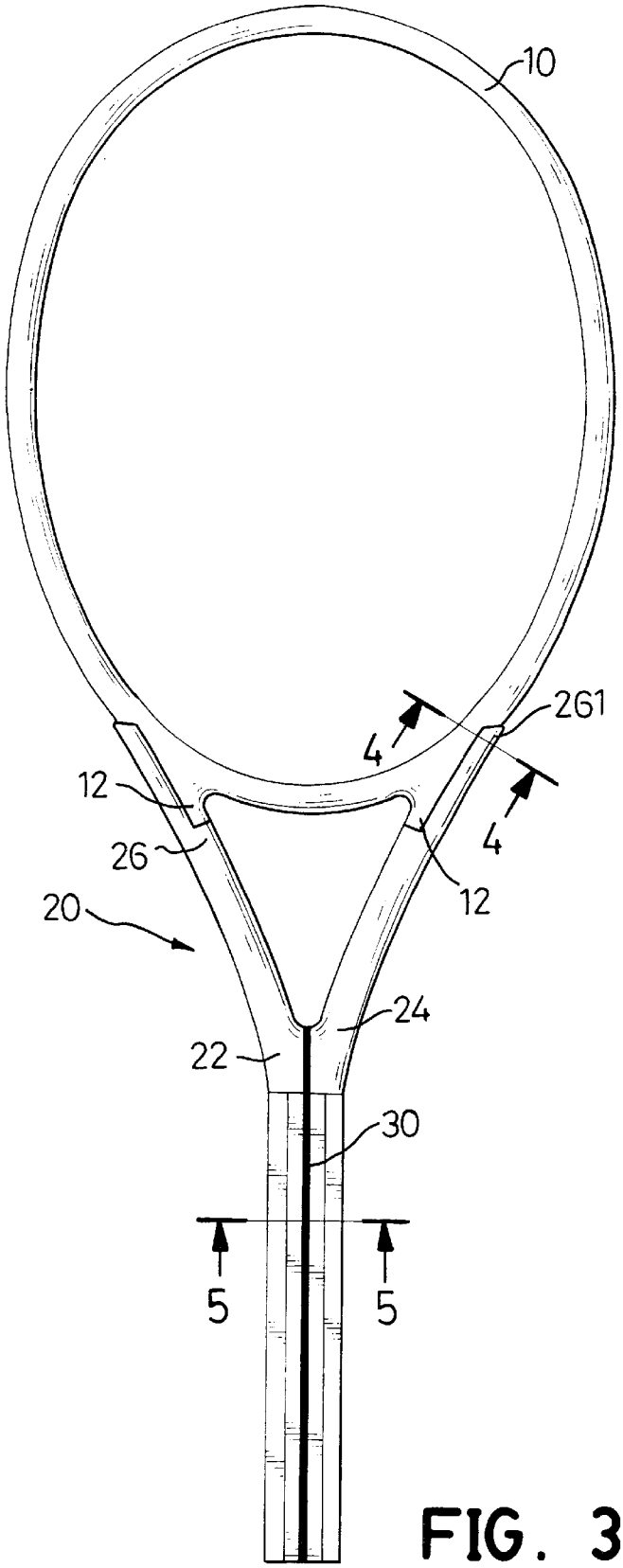
FIG. 3 is a front plan view of a second embodiment of the racket in accordance with the present invention.
Figure 4:
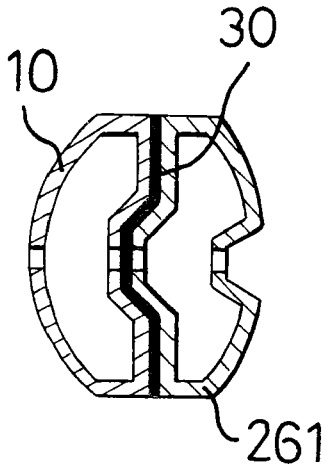
FIG. 4 is an enlarged cross-sectional view of side plan view of the second embodiment of the racket along line 4—4 in FIG. 3.
Figure 5:
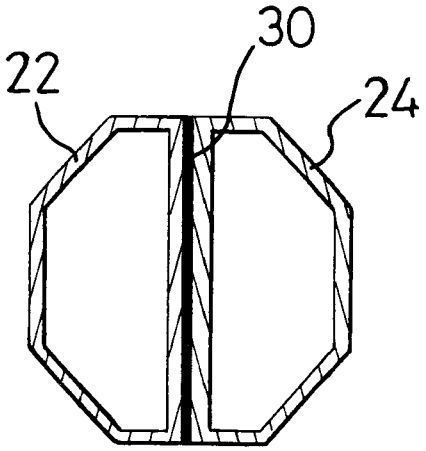
FIG. 5 is an enlarged cross-sectional view of side plan view of a handle of the second embodiment of the racket along line 5—5 in FIG. 3.
Figure 6:
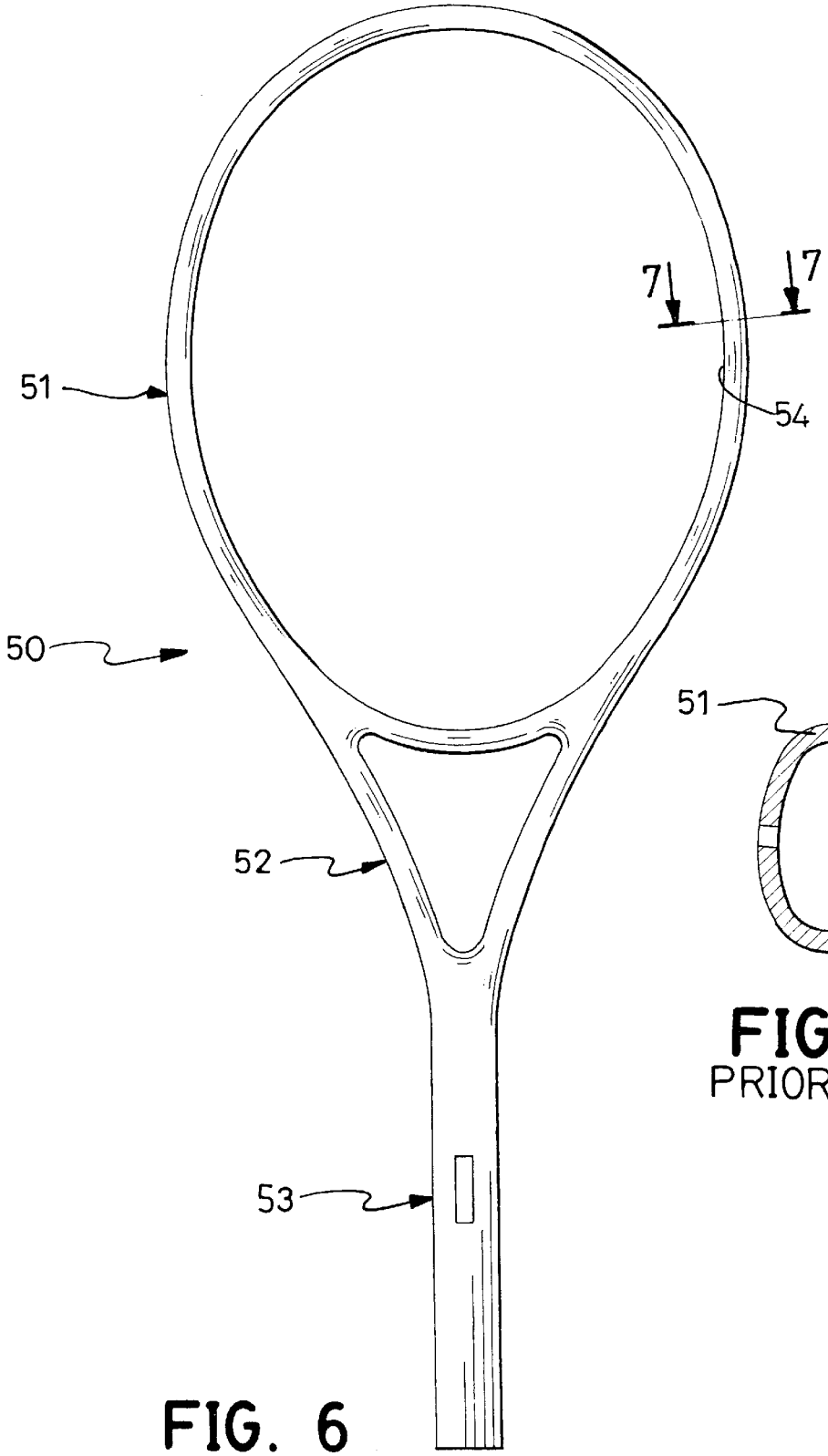
FIG. 6 PRIOR ART
FIG. 6 is a front plan view of a conventional racket in accordance with the prior art.
Figure 7:
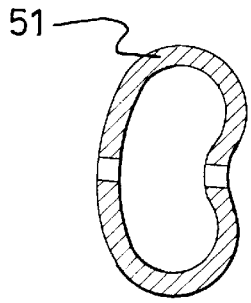
FIG. 7 PRIOR ART
FIG. 7 is an enlarged cross-sectional top plan view of the conventional racket along line 7—7 in FIG. 6.

With reference to FIGS. 3, to 5, a second embodiment of the racket having modified configuration that each distal end (26) has an extending finger (261) corresponding to the connecting stubs (12) of the head (10). With reference to FIG. 4, each extending finger (261) has a convex inner edge (not numbered) and a convex outer edge (not numbered) with a longitudinal groove defined opposite to the convex inner edge. The head (10) further has an outer edge (not numbered) and a groove (not numbered) defined in the outer edge corresponding to the convex inner edge of the extending finger (261). Additionally, the corresponding connecting stubs (12) and extending fingers (261) are bonded together with the resilient material (30) applied between the connecting stubs (12) and extending fingers (261). With reference to FIG. 5, each symmetrical tube (22, 24) has a flat face (not numbered) connected to the other flat face with the resilient material (30) to form the handle (20).

The different sections of the racket can selectively be made of different materials to disrupt and attenuate the transmission of vibration and shock, especially to the handle (20). In the embodiments of this invention, the head (10) can be made of thermosetting resin to make the head (10) strong and the handle (20) can be made of thermoplastic resin to make the handle (20) elastic to reduce vibration.

In addition to the benefits caused by having separate sections of the racket made of different materials, the resilient material (30) used to bond the sections of the anti-shock racket together also absorbs and reduces vibration and shock when striking a ball. The vibration and shock transmitted through the head (10), the resilient material (30) and the handle (20) is greatly attenuated by the time it reaches the hand of the user. Therefore, users feel comfortable and have less chance of sustaining an injury when striking a ball.

It is to be understood, however, that even though numerous advantages of the present invention have been set forth in the foregoing description and function of the invention, the disclosure is illustrative only. Changes may be made in detail within the principles of the invention to the full extent indicated by the broad general meaning of the terms in which the appended claims are expressed.

What is claimed is:

1. racket comprising:

head including an open oval frame having a bottom end and two connecting stubs tangentially formed near the bottom end of the oval frame;

a handle attached to the bottom end of the oval frame of the head, with the handle including a grip portion and a forked end having two tubular, distal ends, with the connecting stubs near the bottom end of the oval frame of the head being slideably received within the tubular, distal ends of the forked end; and a resilient material of an annular shape located around each of the connecting stubs and bonded between each of the tubular, distal ends of the forked end and the corresponding one of the connecting stubs near the bottom end of the oval frame of the head.

2. The racket as claimed in claim 1, with the handle composed of two symmetrical tubes joined longitudinally over a part of their length to form the grip portion and the forked end.

3. The racket as claimed in claim 2, wherein the head is made of thermosetting resin mixed with carbon fiber and the handle is made of thermoplastic resin mixed with carbon fiber.

4. The racket as claimed in claim 3, further comprising:

resilient material bonded between contacting flat faces of the part of the length of the symmetrical tubes.

5. The racket as claimed in claim 2, further comprising:

resilient material bonded between contacting flat faces of the part of the length of the symmetrical tubes.

6. The racket as claimed in claim 1, wherein the head is made of thermosetting resin mixed with carbon fiber and the handle is made of thermoplastic resin mixed with carbon fiber.

* * * * *